United States Patent [19]

Kunka et al.

[11] 4,410,123

[45] Oct. 18, 1983

[54] WIRE STITCHING MACHINE HEAD

[75] Inventors: Bernard P. Kunka; Casper W. Hagemann, both of Racine, Wis.

[73] Assignee: Interlake, Inc., Oak Brook, Ill.

[21] Appl. No.: 313,575

[22] Filed: Oct. 21, 1981

[51] Int. Cl.[3] ..... B27F 7/23

[52] U.S. Cl. ..... 227/8; 227/90

[58] Field of Search ..... 227/8, 82–92

[56] References Cited

U.S. PATENT DOCUMENTS

| | | | |
|---|---|---|---|
| 970,461 | 9/1910 | Briggs . | |
| 1,252,011 | 1/1918 | Maynard . | |
| 2,960,695 | 11/1960 | Hausknecht | 227/90 X |
| 3,490,676 | 1/1970 | Willbond | 227/84 X |
| 4,211,350 | 7/1980 | Kunka et al. | 227/90 X |

OTHER PUBLICATIONS

Interlake Instruction Manual, Interlake Inc., 1–1972.

*Primary Examiner*—Mark Rosenbaum

*Attorney, Agent, or Firm*—Emrich & Lee and Brown, Hill, Dithmar, Stotland, Stratman & Levy

[57] ABSTRACT

A cyclical wire stitching machine includes a reciprocating driving coupled to a staple-forming and drive means, which is in turn coupled by a rack and pinion mechanism to a wire feed means, so that the wire feed means and the staple-forming and driving means reciprocate simultaneously in opposite directions. The wire feed means includes a wire gripper which grips the supply wire for feeding it, while the feed means moves in one direction, to a wire holder where a predetermined length of wire is severed from the supply, the gripper then being locked open for releasing the wire while the feed means retracts in the opposite direction and the fed length of wire is formed into a staple and driven. Thus, during each cycle, the machine feeds a length of wire and forms and drives that same length of wire so that at the end of the cycle there is no severed wire in the wire holder.

20 Claims, 15 Drawing Figures

WIRE STITCHING MACHINE HEAD

BACKGROUND OF THE INVENTION

The present invention relates to a wire stitching or stapling machine of the type which severs and forms staples from a continuous wire and drives the staples into an associated workpiece. In particular, the invention relates to a stitching head for such a machine. Such machines are useful in a variety of applications, such as in bindery, the stapling of cartons or other containers, as well as other types of stapling.

The present invention is an improvement of the wire stitching machine sold by Interlake, Inc., the assignee of the present invention under the trademark "CHAMPION STITCHER". This prior stitching machine, which is in turn an improvement of the machine described in U.S. Pat. No. 1,252,011, includes a stitching head having a wire feed mechanism for feeding a predetermined length of wire from a continuous wire supply to a wire holder, where the length of wire is severed from the supply, and a staple-forming and driving mechanism which forms the severed length of wire into a staple and drives it into an associated workpiece. The wire feed means and the staple-forming and driving means are coupled together so that they undergo a reciprocating movement in tandem, moving together in the same direction in response to an associated drive. Thus, the mechanism undergoes a cyclical reciprocating movement comprising a drive stroke and a return stroke. During each drive stroke the feed means is feeding a predetermined length of wire to the wire holder, while the staple-forming and driving means is forming and driving the length of wire which had been fed during the preceding drive stroke. Both mechanisms then retract simultaneously, and at the end of each cycle there is left in the wire holder a severed length of wire ready to be formed and driven during the next drive stroke.

This type of stitching head operates well in normal heavy duty operations which typically involve very long runs, comprising many thousands of cycles of stapling the same material or material of the same thickness. However, such heads have been found to be unsuitable for use in office applications for the stapling of documents and the like, wherein there are frequent changes in the thickness of the work to be stapled. In the typical office application, it is not uncommon for the thickness of the work being stapled to be changed every few cycles of the machine. This has proven to be an inconvenience with the aforementioned prior heads since, each time the head is adjusted to change the wire draw and the length of staple to be formed and driven, the severed length of wire left in the wire holder from the previous cycle must first be removed. Not only does this necessitate an additional step in the adjustment or change-over operation, but it also creates a waste removal problem. The discarded lengths of wire frequently wind up littering the floor and this has proved to be a considerable disadvantage in the use of the machine.

SUMMARY OF THE INVENTION

It is a general object of the present invention to provide an improved stitching machine which avoides the disadvantages of prior machines while at the same time providing additional operating and structural advantages.

An important object of this invention is the provision of a wire stitching machine of the type which has reciprocating wire feed and staple-forming and driving mechanisms, wherein the wire feed function is effectively separated from the staple-forming and driving function.

It is another object of this invention to provide a cyclical wire stitching machine of the type set forth wherein, at the end of each cycle, there is no severed length of wire in the machine.

It is another object of this invention to provide a cyclical wire stitching machine of the type set forth wherein, during each cycle of operation, the machine forms and drives a length of wire which was fed and severed during the same cycle.

In connection with the foregoing objects, it is another object of this invention to provide a cyclical wire stitching machine of the type set forth, wherein the wire feed means and the staple-forming and driving means undergo reciprocating movements in opposite directions.

These and other objects of the invention are attained by providing in a cyclical wire stitching machine including means operative in each cycle for feeding and severing a length of staple wire from a continuous supply thereof, forming the severed staple wire into a staple and driving the staple through an associated workpiece and against a clincher, the combination comprising: drive means controllable for establishing an operation cycle which begins and ends at a rest position, a wire holder, feed means coupled to the drive means and responsive thereto during a first portion of the cycle for feeding a predetermined length of wire to the wire holder and severing the predetermined length of wire from the associated supply, and staple forming and driving means coupled to the drive means and responsive thereto during a second portion of the cycle for forming into a staple the severed length of wire fed during the first portion of the same cycle and driving the staple into the associated workpiece, whereby at the rest position of the cycle there is no wire in the wire holder.

The invention consists of certain novel features and the combination of parts hereinafter fully described, illustrated in the accompanying drawings, and particularly pointed out in the appended claims, it being understood that various changes in the details may be made without departing from the spirit, or sacrificing any of the advantages of the invention.

DESCRIPTION OF THE PREFERRED EMBODIMENT

Figure 1:
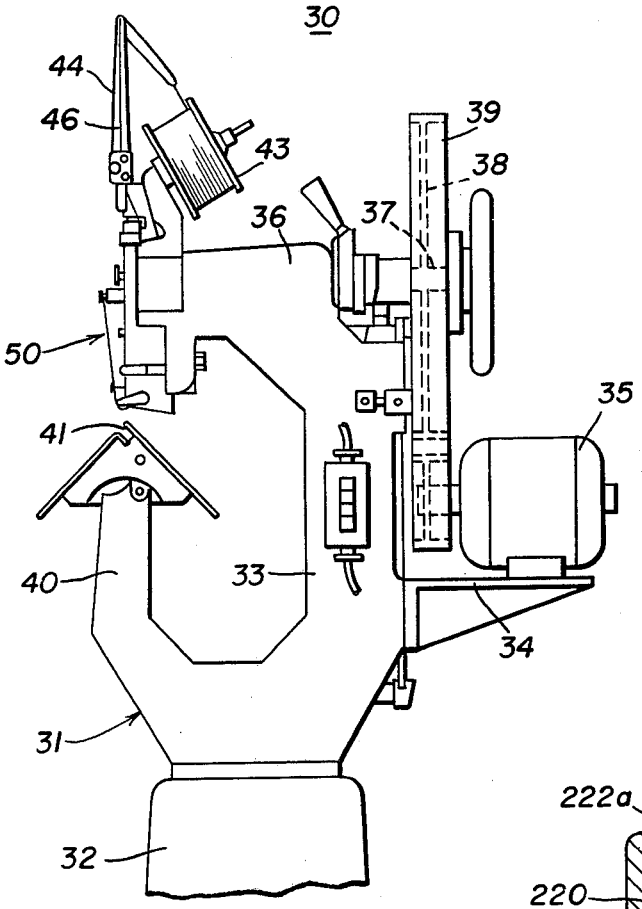
FIG. 1 is a fragmentary side elevational view of a stitching machine incorporating a stitching head constructed in accordance with and embodying the features of the present invention and with the head adjusted for minimum wire draw and illustrated in its neutral position.
Figure 7:
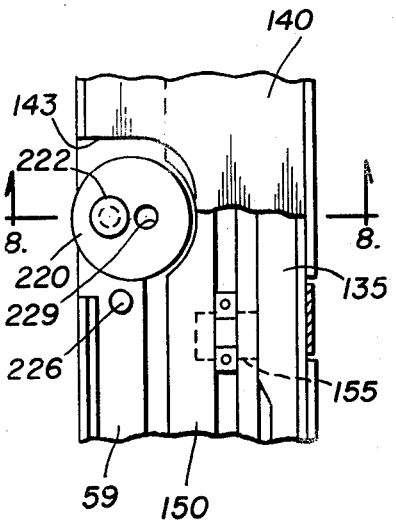
FIG. 7 is a fragmentary front elevational view of the swivel operating cam of the stitching head of FIG. 1, illustrated in an intermediate position.
Figure 8:
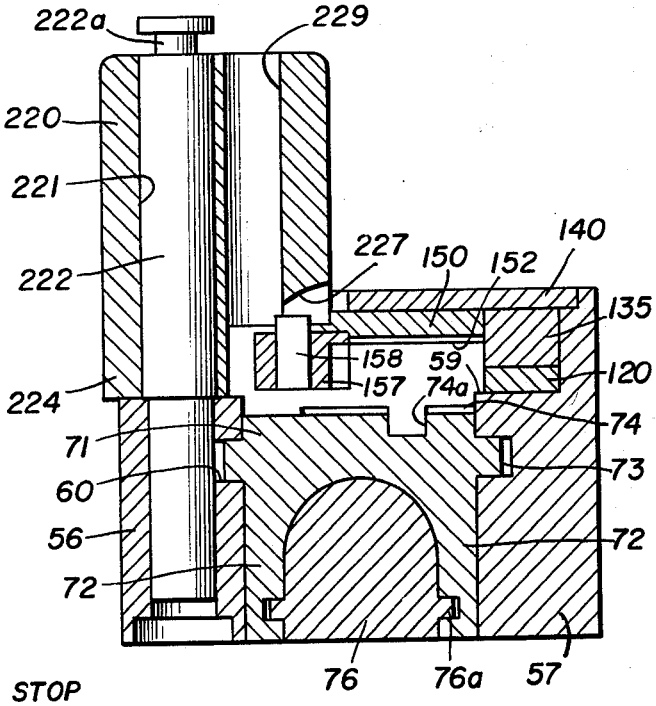
FIG. 8 is an enlarged view in horizontal section taken along the line 8—8 in FIG. 7.

Referring to FIG. 1 of the drawings, there is illustrated a wire stitching machine, generally designated by the numeral 30, and including a stitching head 50 constructed in accordance with and embodying the features of the present invention. With the exception of the stitching head 50, the stitching machine 30 is essentially of conventional construction and includes a frame 31 supported on a suitable pedestal 32 and including an upstanding support post 33. Fixedly secured to the rear end of the support post 33 is a platform 34 supporting thereon an electric drive motor 35. Integral with the support post 33 at the upper end thereof and projecting forwardly therefrom is a generally horizontal support arm 36 which houses a drive shaft 37, the rear end of which is connected to a fly wheel 38 which is coupled by a drive belt 39 to the output shaft of the drive motor 35. At the forward end of the drive shaft is linkage (not shown) for converting the rotary motion of the shaft to a vertically reciprocating motion, which is then transmitted to the stitching head 50 which is fixedly secured to the front end of the support arm 36.

The frame 31 also includes an upstanding clincher post 40 disposed forwardly of the support post 33 and provided at the upper end thereof with a clincher 41 spaced a predetermined short distance below the bottom of the stitching head 50. Carried by the support arm 36 adjacent to the front end thereof is a supply roll 43 of stitching wire 45, the supply portion 46 of the wire 45 being fed along a wire guide 44 to the stitching head 50 in a manner which will be explained more fully below. The machine 30 may be provided with suitable control means for controlling the operation thereof. The machine 30 is generally of the same type as the aforementioned "CHAMPION STITCHER" sold be Interlake, Inc. While a single-head stitching machine 30 is illustrated in FIG. 1, it will be appreciated that the machine 30 could be provided with multiple stitching heads 50 operated in tandem.

Referring now to FIGS. 2 through 8 and 10 through 13 of the drawings, the stitching head 50 includes a metal frame, generally designated by the numeral 51 (FIGS. 3 and 4) which is preferably in the form of a single-piece casting. The frame 51 includes a channel-shaped base portion 52 including a rear wall 53 and two forwardly-extending side walls 54 and 55 (FIGS. 3–5), respectively provided with elongated upstanding extension portions 56 and 57 which are disposed forwardly of the rear wall 53 and cooperate to define a slot therebetween. The forward edges of the side walls 54 and 55 are recessed along the entire lengths thereof to define first relatively shallow shoulders 58 and second deeper shoulders 59 (see FIGS. 4–6). Extending the length of the side walls 54 and 55 a slight distance rearwardly of the level of the second shoulders 59 are elongated rectangular grooves 60. The front edges of the side walls 54 and 55 are cut away at the lower ends thereof to the levels of the second shoulders 59. The side wall 54 is also cut away as at 61 intermediate the ends thereof to the level of the second shoulders 59 (see FIGS. 2 and 10). The rear surfaces of the side wall extension portions 56 and 57 are recessed adjacent to the upper ends thereof, as at 62 (see FIG. 3). The base portion 52 of the frame 51 is provided with an internally threaded bore 63 extending through the rear wall 53 and inclined slightly upwardly and forwardly for receiving therein a hollow bushing plug 65 in which is seated a helical compression spring 66 (see FIG. 4). The spring 66 bears against the rear surface of a lever 67 which is disposed between the side walls 54 and 55 for pivotal movement about the axis of a pivot pin 68. The lower end of the lever 67 is clevis-shaped and carries between the legs thereof a rotatable roller 69.

Disposed between the side walls 54 and 55 is an elongated channel-shaped drive slide, generally designated by the numeral 70, which includes a front wall 71 integral at the opposite sides thereof with rearwardly extending side walls 72 (see FIG. 8), respectively provided with guide rails or keys 73 to be received in the grooves 60 for sliding movement of the drive slide 70 longitudinally of the frame 51. The front wall 71 of the drive slide 70 has a rack 74 formed on the front surface thereof, the teeth of the rack 74 being separated into two parallel rows by an elongated slot 74*a* running the length of the drive slide 70. The lower end of the front wall 71 has a coupling lug 75 projecting forwardly therefrom (see FIG. 4) for a purpose to be explained more fully below.

Disposed between the side walls of the drive slide 70 is a drive block 76 (see FIGS. 4 and 8) which is provided with guide rails or keys 76*a* on the opposite sides thereof, respectively received in complementary grooves on the inner surfaces of the drive slide side walls 72 for sliding movement longitudinally of the drive slide 70. The drive block 76 has a rearwardly projecting lug 77 which is coupled to the drive linkage of the stitching machine 30 for transmitting the reciprocating movement of the drive linkage to the drive slide 70. The lower end of the drive block 76 is recessed to receive therein the upper end of a helical compression spring 78, the lower end of which is seated in a stop member 79 which is fixedly secured between the side walls of the drive slide 70. Also fixedly secured between the drive slide walls 72 at the upper ends thereof is an upper stop member 79*a*, the stop members 79 and 79*a* cooperating to limit the longitudinal movement of the drive block 76 with respect to the drive slide 70. The spring 78 serves to cushion the movement of the drive block 76 at the bottom of its stroke, providing lost motion which prevents damage to the associated workpiece being stapled.

Figure 4:
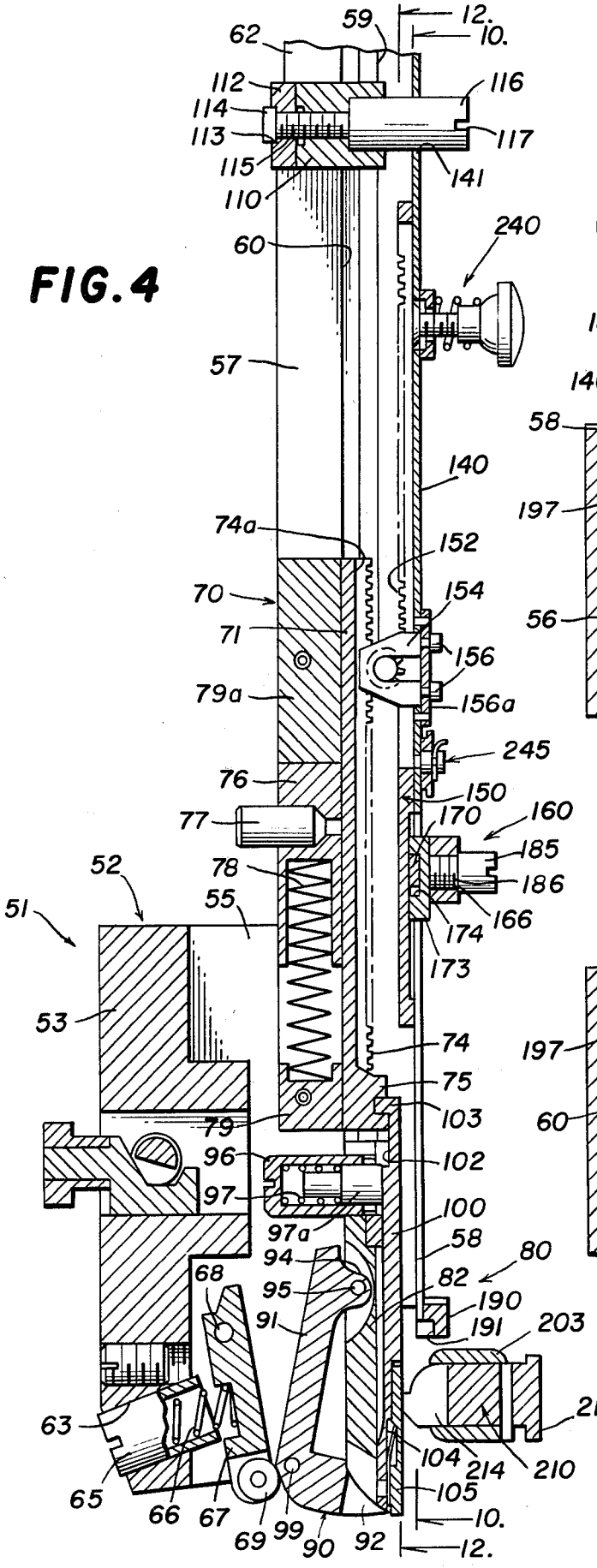
FIG. 4 is a view in vertical section taken along the line 4—4 in FIG. 2.
Figure 6:
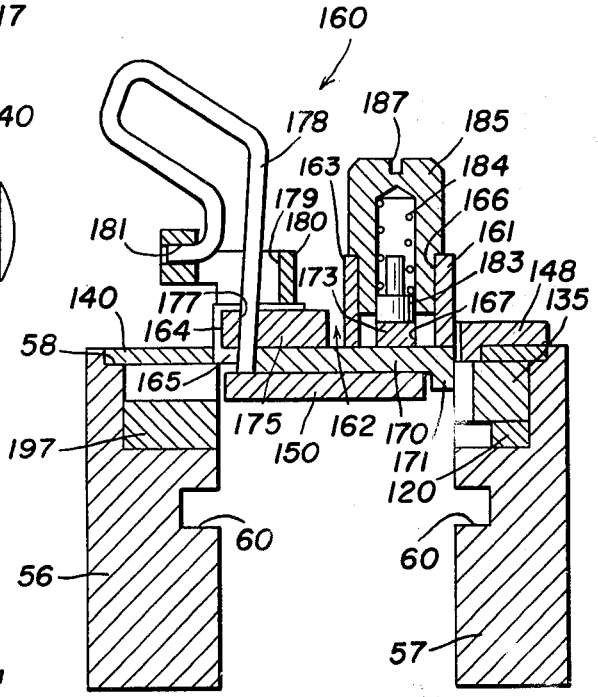
FIG. 6 is a further enlarged sectional view taken along the line 6—6 in FIG. 2.
Figure 5:
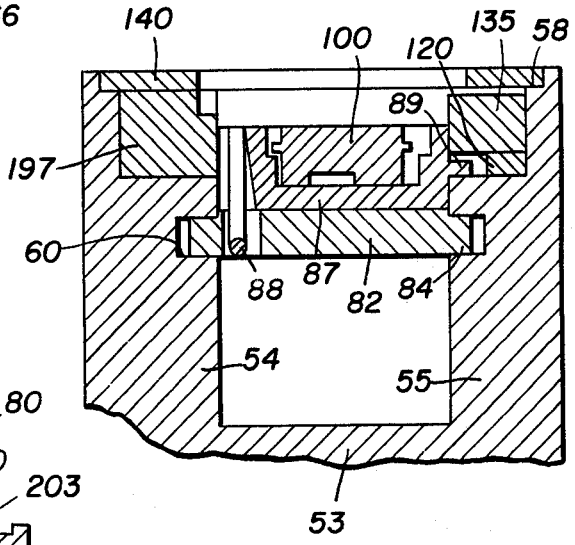
FIG. 5 is a further enlarged fragmentary sectional view taken along the line 5—5 in FIG. 2.
Figure 12:
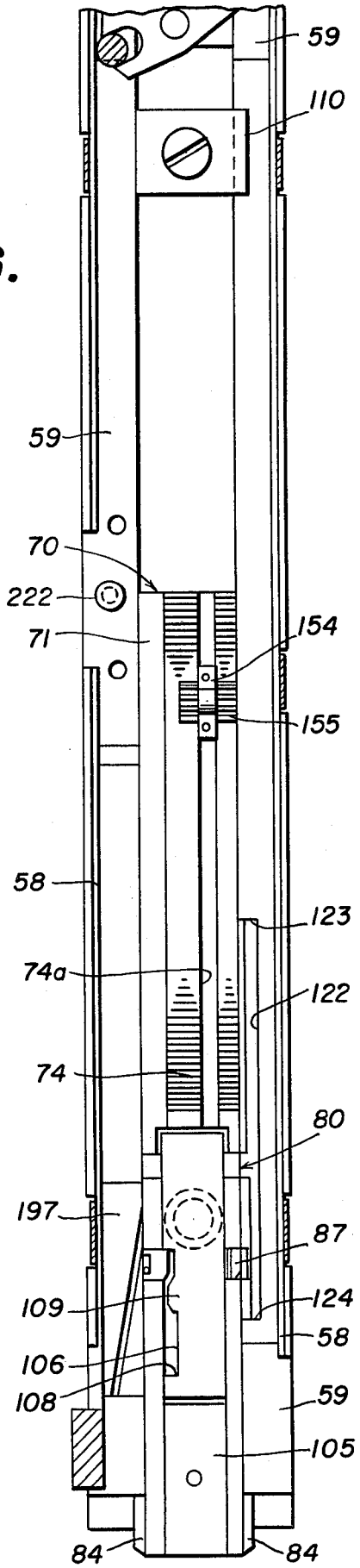
FIG. 12 is a sectional view taken generally along the line 12—12 in FIG. 4 and illustrating the staple-forming and driving mechanism at the end of the forming and driving stroke.
Figure 13:
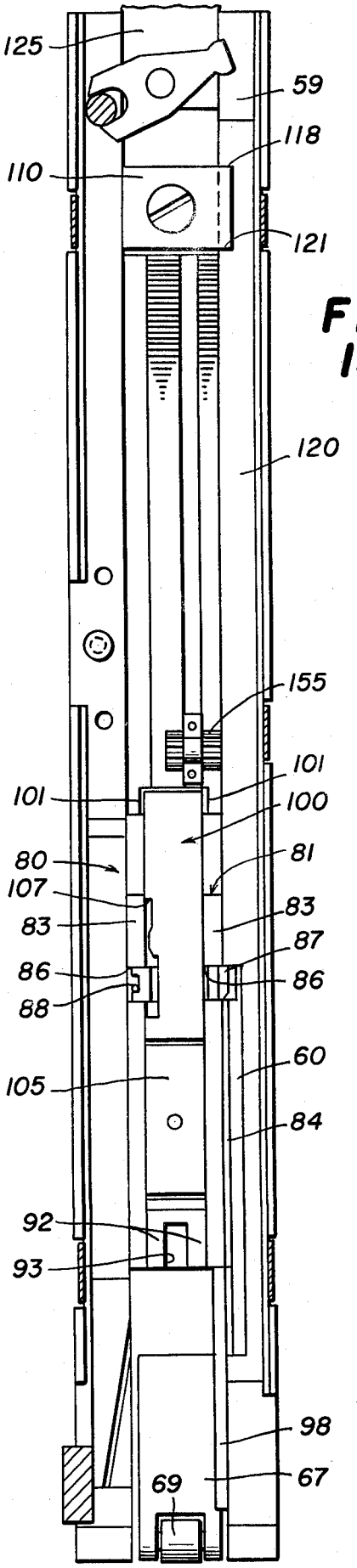
FIG. 13 is a view similar to FIG. 12, but illustrating the staple-forming and driving mechanism at the end of its return stroke.

Coupled to the drive slide 70 is a staple-forming and driving assembly, generally designated by the numeral 80, which includes a bender bar 81, a support lever 90 and a drive bar 100 (see FIGS. 4, 12 and 13). The bender bar 81 is a generally channel-shaped member having a rectangular rear wall 82 and a pair of forwardly extending side walls 83. The bender bar 81 is disposed in the channel between the side walls 54 and 55 of the frame 51 and below the drive slide 70, the side walls 83 being spaced inwardly from the lateral edges of the rear wall 82 so that those edges respectively define guide rails 84 which are slidably received in the grooves 60 for guiding vertical sliding movement of the bender bar 81 in the frame 51.

Figure 2:
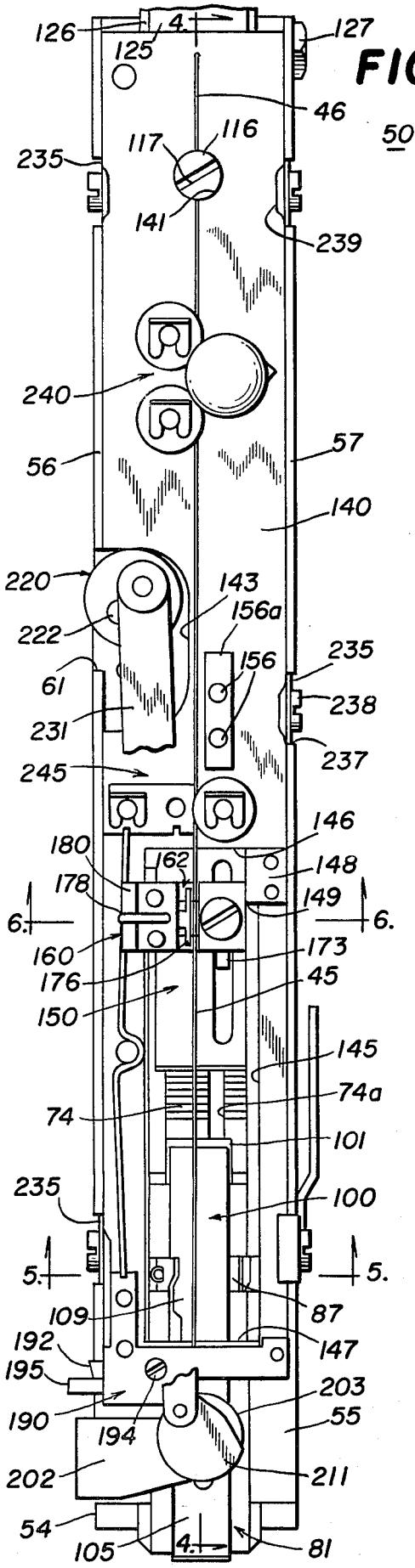
FIG. 2 is an enlarged front elevational view of the stitching head of FIG. 1, with a portion broken away more clearly to show the construction.

Laterally aligned notches 86 are respectively formed in the side walls 83 for receiving therein a laterally extending latch 87 which is resiliently urged toward the right, as viewed in FIG. 2, by an arm of a generally U-shaped wire spring 88 which extends upwardly through a complementary opening in the rear wall 82 (see FIG. 5), the other end (not shown) of the spring being anchored in the rear wall 82. The latch 87 is a generally U-shaped member (see FIG. 5), the spring 88 bearing against one leg thereof and the other leg thereof being provided with a laterally outwardly extending stop flange 89 which rides on the associated shoulder 59 of the frame 51 for a purpose to be explained more fully below.

Disposed behind the bender bar 81 and pivotally coupled thereto is a support lever, generally designated by the numeral 90 which has a rectangular body 91 provided at the lower end thereof with a pair of laterally spaced-apart and forwardly extending feet 92 defining a slot 93 therebetween. The upper end of the body 91 is provided with a forwardly extending attachment flange 94 (see FIG. 4) which is received in a complementary recess in the rear of the bender bar rear wall 82 and is pivotally coupled thereto by a pivot pin 95. The side walls 83 of the bender bar 81 extend downwardly below the lower end of the rear wall 82 to accommodate therebetween the feet 92 of the support lever 90. The support lever 90 is provided with a laterally extending cam pin 99 which is disposed for camming engagement with a guide plate 98 fixedly secured to the inner surface of the frame side wall 55 (see FIG. 10).

The rear wall 82 of the bender bar 81 has a circular bore therethrough adjacent to the upper end thereof for threadedly receiving therein a hollow bushing 96 in which is seated a helical compression spring 97 which bears against a friction pad **97*a* also disposed in the bushing 96 (see FIG. 4). The friction pad 97*a* is resiliently urged into frictional engagement with the rear surface of an elongated rectangular drive bar 100 which is disposed in the channel between the side walls 83 of the bender bar 81**.

The drive bar 100 is provided along the side edges thereof with laterally outwardly extending guide flanges 101 (FIG. 13) respectively slidably received in complementary grooves in the inner surfaces of the side walls 83. The drive bar 100 has a recess 102 formed in the rear surface thereof adjacent to the upper end thereof to form a coupling lip 103 which is disposed in a complementary slot in the coupling lug 75 of the drive slide 70 (see FIG. 4). The front surface of the drive bar 100 is provided with a recess 104 at the lower end thereof for receiving therein a flat driver member 105, the lower end of which projects a slight distance downwardly below the lower ends of the bender bar 81 and the drive bar 100. The drive bar 100 is provided with an elongated recess 106 in the left-hand side thereof, as viewed in FIG. 2, respectively forming at the upper and lower ends thereof stop surfaces 107 and 108 (see FIGS. 12 and 13). A laterally extending cam projection 109 is formed intermediate the ends of the recess 106 for a purpose to be explained more fully below.

Disposed between the extension portions 56 and 57 of the frame side walls 54 and 55 is an adjustment slide block 110 which is provided with laterally extending guide ribs or keys (not shown) respectively slidably received in the grooves 60 of the frame 51. Disposed against the rear end of the slide block 110 is a retainer 112 (see FIG. 4) which has a retangular slot 113 formed in the rear surface thereof for receiving therein the head 114 of a threaded stud 115, which extends forwardly through complementary aligned bores in the slide block 110 and retainer 112. The bore in the slide block 110 is enlarged at the front end thereof for receiving a hollow cylindrical nut 116 having a slot 117 in the head thereof and being threadedly engaged with the stud 115. The retainer 112 has laterally extending flanges (not shown) which overlap the rear surfaces of the frame side wall extensions 56 and 57 along the recesses 62 therein. Thus, when the nut 116 is tightened onto the stud 115 the slide block 110 is securely clamped in place on the frame 51. When the nut 116 is loosened, the slide block 110 may be slid vertically along a limited range of adjustment movement determined by the length of the recesses 62 for a purpose to be explained hereinafter.

The slide block 110 has a laterally extending positioning lip 118 (FIG. 13) which rides upon the adjacent shoulder 59 of the frame 51. Also resting on the shoulder 59 is an elongated travel limit slide bar 120 which has a short rectangular recess 121 in which the slide block positioning lip 118 is received, thereby to position the slide bar 120 longitudinally of the frame 51. The slide bar 120 is also provided adjacent to the lower end thereof with an elongated rectangular recess 122 in the left-hand side thereof, as viewed in FIGS. 12 and 13, defining at the upper and lower ends thereof stop surfaces 123 and 124, respectively, which are engageable by the stop flange 89 of the bender bar latch 87 to limit the longitudinal travel of the bender bar 81.

Disposed between the frame side wall extension portions 56 and 57 at the upper ends thereof is a wire guide bracket 125 (FIGS. 2 and 3) which is provided with laterally outwardly extending guide ribs or keys 125 keyed into the grooves 60 in the frame 51. The bracket 125 is fixedly secured to the frame 51 by a mounting screw 127 (see FIG. 3) and carries thereon the wire guide 44 illustrated in FIG. 1.

Figure 10:
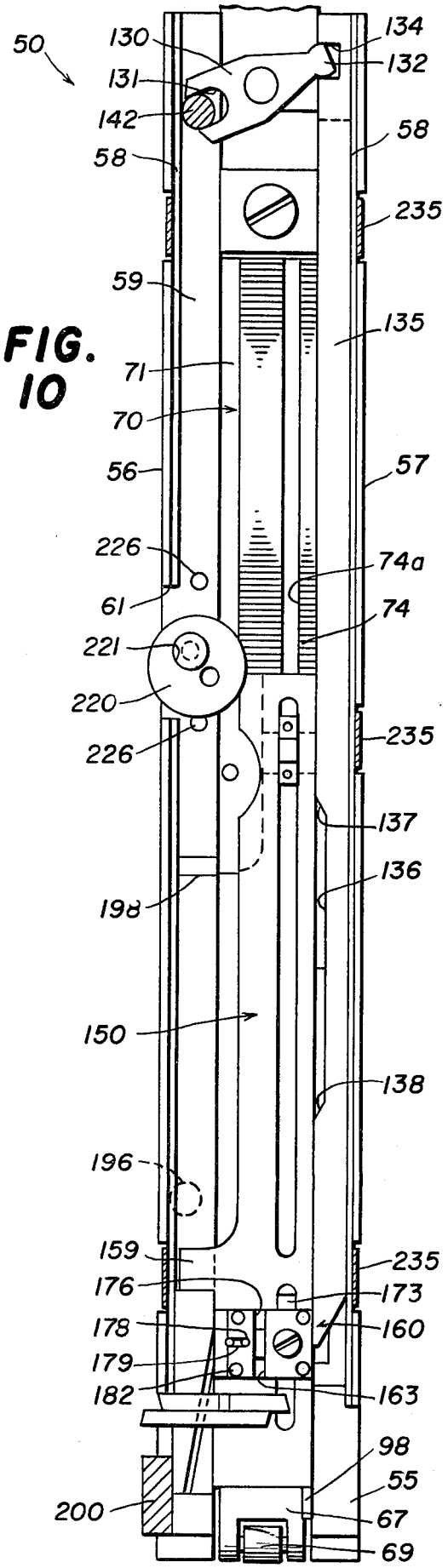
FIG. 10 is a view in vertical section taken generally along the line 10—10 in FIG. 4, and illustrating the wire feed mechanism at the end of its feed stroke.
Figure 11:
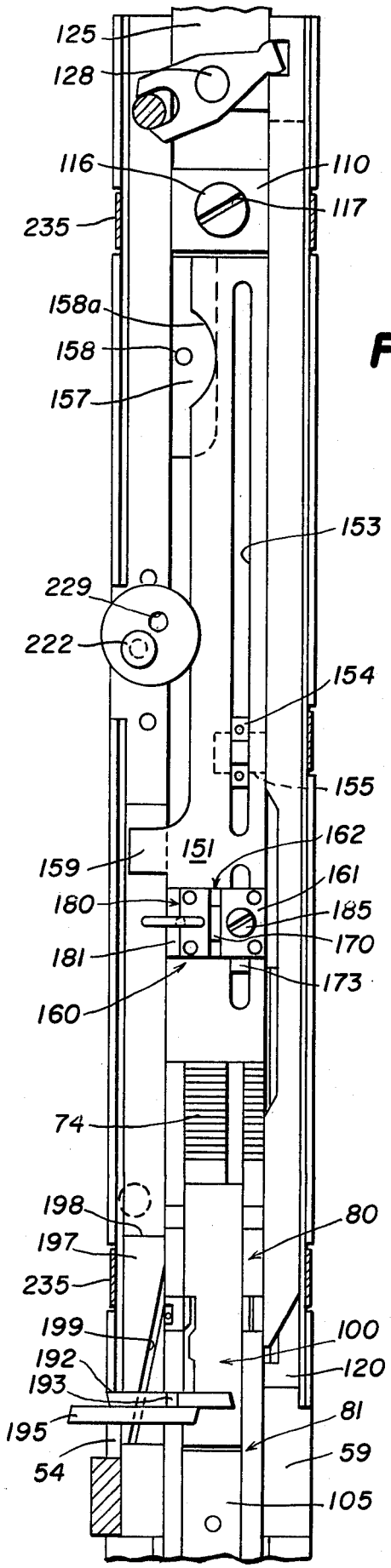
FIG. 11 is a view similar to FIG. 10, but illustrating the wire feed mechanism at the end of its return stroke.

The wire guide bracket 25 carries a forwardly projecting pivot stud 128 which is received in a complementary bore in a grip release lever 130 for pivotally mounting same (see FIGS. 10 and 11). The lever 130 has a generally U-shaped slot 131 at one end thereof and is provided at the other end thereof with a projection 132 disposable in a rectangular recess 134 formed at one end of an elongated grip release slide bar 135 which overlies the slide bar 120. The slide bar 135 is also provided with an elongated recess 136 adjacent to the lower end thereof which defines at the upper and lower ends thereof inclined cam surfaces 137 and 138, respectively. It will be appreciated that as the lever 130 is rotated the slide bar 135 is slid vertically longitudinally of the frame 51.

In assembling the parts of the stitching head 50 heretofore described, the staple-forming and driving assembly 80 is first slid into the frame 51 from the top thereof along the grooves 60. Next the subassembly comprising the drive slide 70, the drive block 76, the spring 78 and the stops 79 and **79*a* is slid into the frame from the top and the drive bar coupling lip 103 is coupled to the coupling lug 75 of the drive slide 70 so that the staple-forming and driving assembly 80 will move in tandem with the drive slide 70. Next, the slide block 110 is slid into the frame 51 and secured in place with the retainer 112, stud 115 and nut 116. Finally, the wire guide bracket 125 is secured in place and the slide bars 120 and 135 and the lever 130** are laid in place.

This entire mechanism is then covered by a face plate 140 (FIGS. 2 and 4) which has a circular aperture 141 therein for receiving therethrough the nut 116, the face plate 140 being rectangular and dimensioned to rest upon the shoulders 58 of the frame 51. Fixedly secured to the face plate 140 and projecting rearwardly therefrom is a pin 142 which is disposed in the slot 131 of the lever 130. The face plate 140 has a large, generally rectangular recess 143 formed in the left-hand side thereof, as viewed in FIG. 2, generally adjacent to the cutout portion 61 in the frame side wall extension portion 56. Formed in the face plate adjacent to the lower end thereof is a large rectangular aperture or window 145 defining at the upper and lower ends thereof stop surfaces 146 and 147 respectively. Fixedly secured to the face plate 140 and projecting into the window 145 at the upper right-hand corner thereof is a cam block 148 having a cam surface 149.

Disposed along the rear surface of the face plate 140 is an elongated, flat, generally rectangular feed plate 150 (FIGS. 2, 4, 10 and 11), the lower end of which projects well below the stop surface 146 into the window 145. Formed on the rear surface of the feed plate 150 is a rack 152, the teeth of which are separated into two parallel rows by an elongated slot 153 formed through the feed plate 150. Disposed in the slot 153 is a yoke 154 rotatably supporting a pinion 155 behind the feed plate 150, the parts being arranged so that the pinion 155 is disposed in meshing engagement with both of the racks 74 and 152, the rear end of the yoke 154 being accommodated in the slot **74*a* in the rack 74. The yoke 154 is coupled by screws 156 to a mounting plate 156 which overlies the front surface of the face plate 140 and is fixedly secured thereto as by rivets, thereby securely to hold the pinion 155 in place and also to retain the feed plate 150 against the rear surface of the face plate 140, while accommodating sliding movement thereof longitudinally of the face plate 140. Fixedly secured to the rear surface of the feed plate 150 adjacent to the upper end thereof along the left-hand side thereof, as viewed in FIG. 11, is a pin block 157 carrying thereon a forwardly projecting pin 158 disposed alongside and generally centrally of an arcuate recess 158*a* in the adjacent side edge of the feed plate 150. Projecting laterally from the left-hand side of the feed plate 150, as viewed in FIGS. 10 and 11, is a cutter drive arm 159** for operating a wire cutter mechanism in a manner to be described below.

The lower end of the feed plate 150 has an increased width and has fixedly secured to the front surface 152 thereof a wire gripping assembly, generally designated by the numeral 160, which extends forwardly through the window 145 in the face plate 140. Referring in particular to FIGS. 2, 4, 6 and 10 of the drawings, the wire gripping assembly 160 includes a housing block 161 which is riveted to the feed plate 150 and has a rectangular channel 162 formed therein for accommodating the associated wire 45, the right-hand side of the channel 162, as viewed in FIG. 10, defining a bearing surface 163. Extending laterally from the channel 162 to the left-hand edge of the housing block 161 is a slot 164 (see FIG. 6). Formed in the rear surface of the housing block 161 and extending transversely thereacross below the level of the channel 162 is a rectangular recess 165 which communicates with a rectangular recess 167 disposed at right angles thereto. A cylindrically internally threaded bore 166 extends through the housing block 161 from the front to the rear surfaces thereof and communicates with the recesses 165 and 167.

Disposed in the recess 165 is a latch 170 (see FIG. 6) provided at the right-hand end thereof with a cam head 171. Diposed in the recess 167 and overlying the latch 170 is an elongated, U-shaped lock bar 173 which straddles the latch 170, the lower end of the lock bar 173 being slidable into and out of a notch in the lower edge of the latch 170. Disposed in the slot 164 is a grip bar 175 which has an enlarged serrated or toothed head 176 (see FIG. 2) disposed in the channel 162 for cooperation with the bearing surface 163 to grip the associated wire 45 therebetween. The grip bar 175 has an aperture 177 therein in which is received one end of a spring wire 178 which extends upwardly through a slot 179 in a retainer block 180 which is fixedly secured to the front of the housing block 161 by screws 162, the other end of the spring wire 178 being anchored in a bore 181 in the retainer block 180. Received in the bore 166 is the threaded end 186 of a hollow stud 185. Seated in the stud 185 is a a helical compression spring 184 which resiliently urges a friction pad 183 downwardly into frictional engagement with the upper surface of the lock bar 173. The stud 185 has a slot 187 in its head to facilitate insertion and removal thereof.

In operation the spring wire 178 bears against the left-hand end of the latch 170 and resiliently urges it to bring the cam head 171 into camming engagement with the cam block 148 and with the cam surface 138 of the slide bar 135, when the lock bar 173 is disposed in its downward position, illustrated in FIG. 2, out of the notch in the latch 170. Simultaneously, the spring wire 178 is moving the grip bar head 176 against the bearing surface 163 of the housing block 161 to grip the wire 45. Thus, the wire gripping assembly 160 is moved to its closed or gripping condition. When the latch 170 and grip bar 175 are held to the left against the urging of the spring wire 178 by the cam block 148 or the cam surface 138 of the slide bar 135, the lock bar 173 may be moved upwardly into the notch in the latch 170 thereby to prevent the latch 170 from moving to the right and to lock the wire gripping assembly 160 in an open condition. The friction pad 183 holds the lock bar 173 in position and prevents accidental movement thereof.

Fixedly secured to the face plate 140 at the lower end thereof is a cutter housing 190 having a channel 191 (FIG. 4) formed in the rear surface thereof for accommodating therein a fixed cutter 192 and a movable cutter 195. The fixed cutter 192 has a key 193 on the front surface thereof (FIG. 11) which is received in a slot in a stud 194 in the cutter housing 190 (see FIG. 2) to hold the cutter 192 in place. The movable cutter 195 has a key (not shown) on the rear surface thereof which is disposed in an elongated cam groove 199 formed in the front surface of a drive slide 197 which is slidably disposed on the shoulder 59 of the frame side wall 54. The drive slide 197 has an elongated recess 198 formed in the front surface thereof and in which the arm 159 of the feed plate 150 is seated. As the arm 159 engages the upper and lower ends of the recess 198 it moves the drive slide 197 upwardly and downwardly for effecting a cammed lateral movement of the movable cutter 195 which cooperates with the fixed cutter 192 to sever the wire 45, as will be explained more fully below. A friction pad 196 (see FIG. 10) may be seated in a bore in the frame side walls 54, resiliently to bear against the underside of the drive slide 197 to hold it in place and prevent accidental movement thereof.

Fixedly secured to the frame side wall 54 is a bracket 200 (FIGS. 2–4) which is provided at the front end thereof with an arm 202 which extends laterally across the front of the frame 51 and has formed at the distal end thereof a cylindrical sleeve 203. The front edge of the sleeve 203 is shaped to form a cam surface 205 and a stop surface 206. Rotatably disposed in the sleeve 203 coaxially therewith is a cylindrical wire holder 210 which has an enlarged part-circular head 211 which limits the depth of insertion of the wire holder 210. Extending radially outwardly from the wire holder 210 is a cam pin 213 disposed for camming engagement with the cam surface 205 on the sleeve 203, so that as the wire holder 210 rotates it is moved axially inwardly and outwardly by the cam action.

Figure 9:
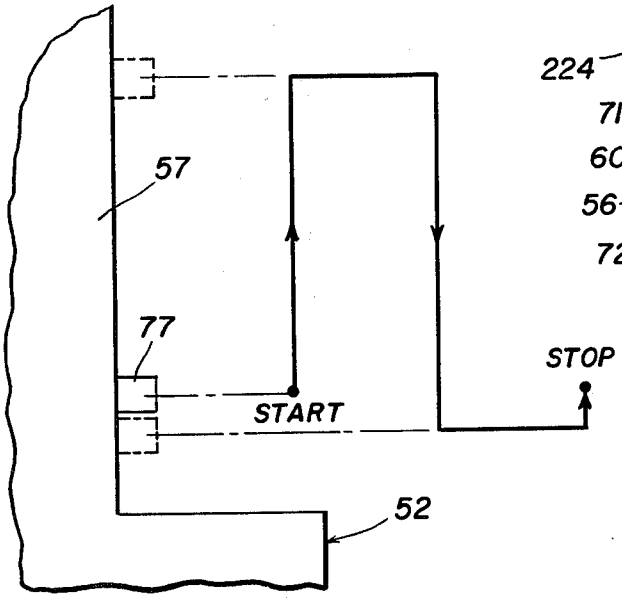
FIG. 9 is a diagrammatic view illustrating the movement of the drive lug of the stitching head of the present invention during a complete cycle of operation.

The wire holder 210 is similar to that disclosed in FIG. 9 of U.S. Pat. No. 1,252,011 and includes a wire-receiving slot 214 extending diametrically therethrough. The inner end of the wire holder 210 is cut to define cam surfaces 216 which terminate in guide edges 217 which are aligned perpendicularly to the slot 214 and cooperate with a hook (not shown) pivotally mounted in the wire holder 210 for holding the associated wire 45. In operation, the wire holder 210 is initially disposed in the position illustrated in FIGS. 2 through 4. When the staple-forming and driving assembly 80 retracts, the wire holder 210 drops rearwardly in the sleeve 203 as will be explained below, and the wire 45 is fed through the slot 214. When the wire holder 210 is rotated through 90° counterclockwise, as viewed in FIG. 2, in a manner to be explained below, the cam surfaces 216 slide along the vertical wire while the wire holder 210 moves axially outwardly under the action of the cam pin 213 until the guide surfaces 217 are brought into engagement with the wire 45. The wire 45 is then cut. As the wire holder 210 is rotated back to its original position the severed piece of wire is held by the hook against the guide surfaces 217 and the severed wire segment rotates with the wire holder 210 to a horizontal position.

The rotation of the wire holder 210 is effected by a cylindrical operating cam 220 which has an eccentric bore 221 extending therethrough for receiving therein a mounting pin 222 which is fixedly secured to the shoulder 59 of the frame side wall 54 centrally of the cutout 61. The distal end of the mounting pin 222 projects forwardly beyond the front of the operating cam 220 and has a necked-down portion **222*a* thereat. The rear end of the operating cam 220 is cut away to form a pedestal 224. Formed in the outer surface of the cam 220 are two flat stop surfaces 225 (see FIG. 3) disposed for engagement with the left-hand edge of the feed plate 150 above the arm 159 thereof and with stop pins 226 carried by the frame side wall 54. A radial slot 227 is formed in the cam 220 between the stop surfaces 225 (see FIG. 8) for receiving therein the pin 158 carried by the feed plate 150**.

In operation, as the feed plate 150 moves downwardly, the cam 220 (FIGS. 2, 3, 7 and 8) is held against rotation by the engagement of the stop surfaces 225 with the edge of the feed plate 150 and the upper stop pin 228. As the feed plate 150 continues to move downwardly, the pin 158 moves into the slot 227 to effect rotation of the cam 220, this rotation being accommodated by the arcuate recess **158*a* in the feed plate 150. As the pin 158 moves past the cam 220, it moves out of the slot 227, further rotation of the cam 220 being prevented by engagement of the stop surfaces 225 with the side edge of the feed plate 150 and the other stop pin 228**.

The cam 220 has a second bore 229 extending therethrough for receiving therein a pin 230. The pin 230 is provided adjacent to the front end thereof with an enlarged-diameter coller 232 which is accommodated in the necked-down portion **222*a* of the pin 222. The collar 232 is provided with an arcuate recess (not shown) therein to facilitate insertion thereof in the bore 229 by providing clearance past the end of the pin 222. The outer end of the pin 230 is fixedly secured to one end of an elongated operating spring arm 231, the other end of which is provided with a pin 234 receivable in a complementary recess in the head 211 of the wire holder 210. Thus, it will be appreciated that through the arm 231 the clockwise rotation of the cam 220 effects a counterclockwise rotation of the wire holder 210, the spring action of the arm 231 also serving resiliently to urge the wire holder 210 axially into the sleeve 203**.

The face plate 140 is secured in place on the frame 51 by a plurality of retaining clips 235 (FIGS. 2 and 3) which are respectively seated in grooves 237 in the outer surfaces of the frame side walls 54 and 55 and are secured thereto by fasteners 238. Each of the clips 235 is provided adjacent to the upper end thereof with an inwardly projecting lip 239 which extends over the adjacent edge of the face plate 140 for locking it in place. Secured to the front of the face plate 140 adjacent to the upper end thereof is a wire straightner assembly, generally designated by the numeral 240, which is of conventional construction and is adjustable for varying the degree of camber imparted to the wire 45. Also carried by the face plate 140 immediately above the window 145 is a wire check pawl assembly 245 which is also of conventional construction and prevents reversal of the wire 45 during the up stroke of the feed plate 150.

Referring now to FIG. 9 of the drawings, it is a significant aspect of the present invention that there is provided a unique pattern of reciprocating movement of the mechanism during each cycle of the stitching head 50. FIG. 9 illustrates the movement of the lug 77 during each cycle. At the start of the cycle the lug 77 is disposed at a neutral position adjacent to, but spaced from, the bottom of the stroke. The reciprocating movement of the lug 77 then proceeds in accordance with the arrows in FIG. 9 upwardly to the top of the stroke, back down to the bottom of the stroke and then up to the neutral or rest position.

Figure 3:
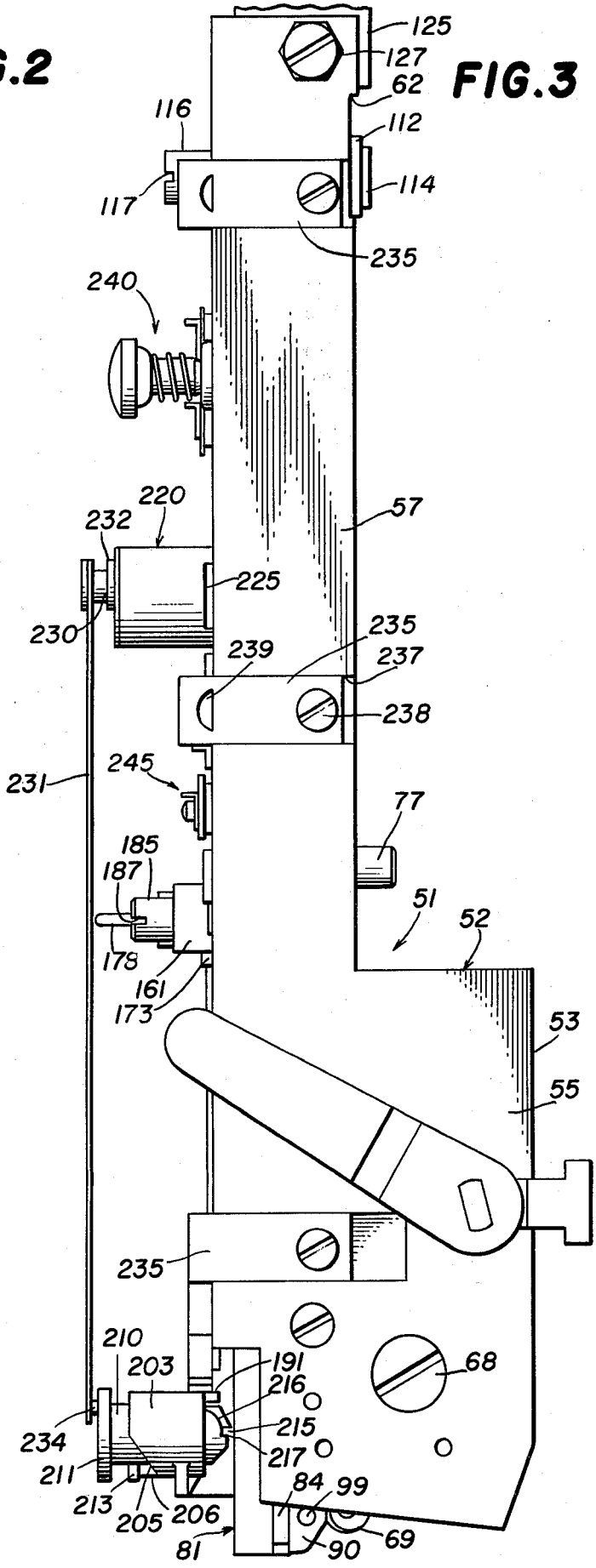
FIG. 3 is a side elevational view of the stitching head of FIG. 2 as viewed from the right-hand side thereof.

When the lug 77 is in its neutral position the remainder of the mechanism of the stitching head 50 is in the position illustrated in FIGS. 2–4 of the drawings, with the staple-forming and driving assembly 80 projecting below the bottom of the frame 51 but retracted slightly from its lowermost position, and with the wire gripping assembly 160 disposed slightly below the upper edge of the window 145 in the face plate 140, but with the cam head 171 of the latch 170 still in camming engagement with the cam block 148 for holding the wire gripping assembly 160 in its open condition wherein the grip bar 175 is out of contact with the wire 45. The cam pin 213 of the wire holder 210 is disposed in engagement with the stop surface 206 of the sleeve 203, the wire holder 210 being pushed partially out of the sleeve 203 by engagement of the inner end thereof with the drive bar 100 (see FIG. 3).

Figure 14:
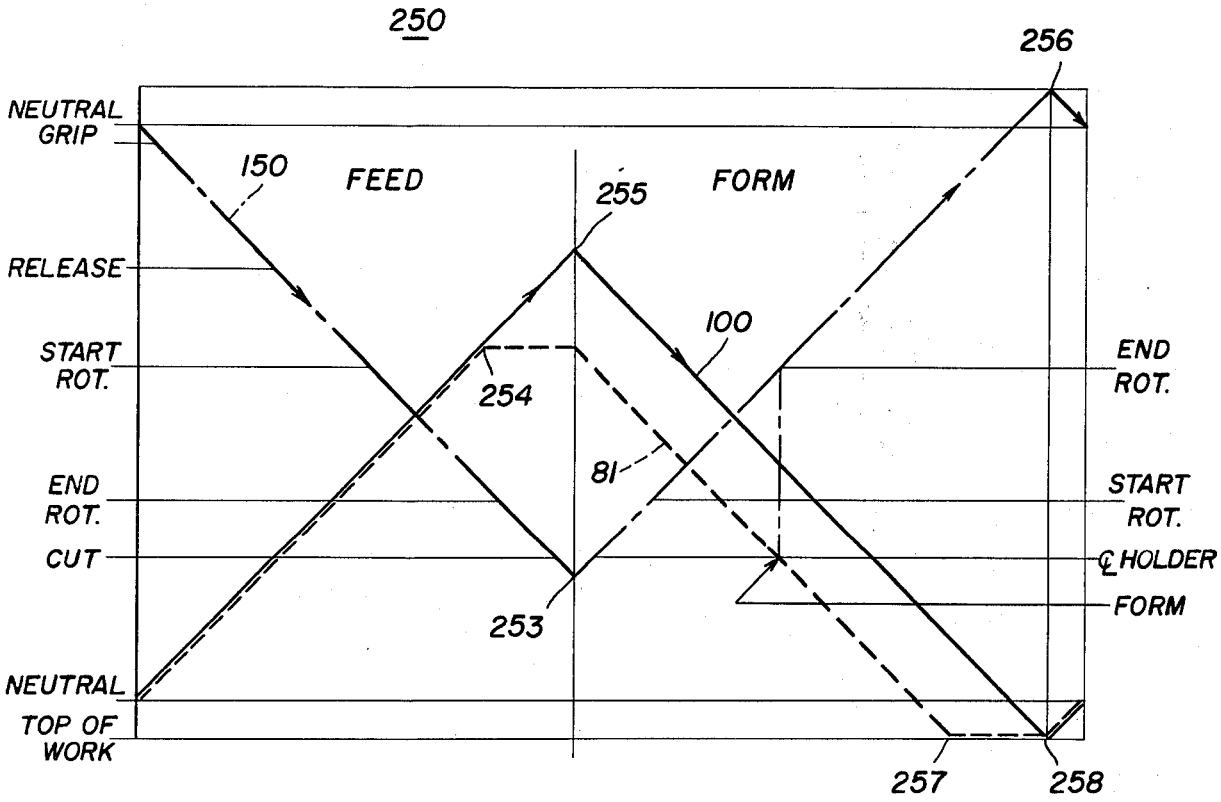
FIG. 14 is a graph illustrating the movements of several parts of the stitching head of the present invention during a complete operating cycle, with the feed mechanism adjusted for minimum wire draw.

Referring now also to FIG. 14 of the drawings, the operation of the stitching head 50 through a complete cycle will be explained in detail. FIG. 14 is a graph which essentially illustrates the reciprocating movement of the parts of the stitching head 50 with the distance being measured along the vertical axis and with the horizontal axis representing time. The graph depicts the movement of the feed plate 150, the bender bar 81 and the drive bar 100, respectively, by three different lines designated by the numbers of those parts.

It is possible to adjust the length of wire fed by the machine in each cycle between maximum and minimum lengths. FIGS. 2–14 of the drawings all illustrate the stitching head 50 in a condition of adjustment for minimum wire feed draw. This adjustment is effected by movement of the face plate 140. More specifically, when it is desired to make this adjustment, the nut 116 is loosened, thereby freeing the adjusting slide block 110 and permitting that block to be moved along with the face plate 140 upwardly and downwardly the length of the recesses 62 (FIG. 3) in the rear of the frame 51. It will be noted that in the minimum wire draw position illustrated in the drawings, the face plate 140 and the slide block 110 are disposed downwardly as far as they can go. In order to move them upwardly to increase the length of wire draw, the face plate 140 is moved upwardly, pulling with it the slide block 110 through the operation of the nut 116.

As the slide block 110 moves it carries with it the slide bar 120 because of the engagement of the positioning lip 118 in the slide bar recess 121. Also, it will be appreciated that the face plate 140 carries with it the feed plate 150. As the face plate 140 moves up, the pin 142 thereon pivots the lever 130 in a clockwise direction, as viewed in FIGS. 10 and 11, thereby moving the slide bar 135 downwardly. Thus, the wire gripping assembly 160 will have to travel downwardly further before engaging the lower cam surface 138 of the slide bar 135 to unlatch the grip bar 175 and move it to its open position for releasing the wire. Also, because the face plate 140 has been moved up, the cam block 148 has also been moved up and this means that the wire gripping assembly 160 will move out of engagement therewith and close at a higher position at the beginning of the wire feed stroke. Thus, by moving both the face plate and the slide bar 135 in opposite directions, there is effected an increase in the length of wire fed, while maintaining the fed length of wire centered with respect to the wire holder 210, with substantially equal lengths of wire projecting thereabove and therebelow. It is also necessary to move the lug 77 the same distance as the face plate 140, by means of a separate adjustment not shown. Alternatively, the lug 77 and the slide block 110 may be coupled to a common adjustment device for simultaneous adjustment thereof.

Initially, the supply portion 46 of the wire 45 is fed from the supply roll 43 along the wire guide 44 and then downwardly across the front of the stitching head 50, the leading end of the wire 45 being fed through the wire straightener assembly 240 and the wire check pawl assembly 245 and thence through the wire channel 162 of the wire gripping assembly 160 and a bore in the cutter housing 190. The wire straightener assembly 240 is adjusted to its proper setting and the machine 30 is then ready for operation. Upon actuation of the associated control mechanism and energization of the drive motor 35, the lug 77 will be driven upwardly from its neutral position, illustrated in FIGS. 2 through 4. This effects a corresponding upward movement of the drive bar 100, which is directly coupled to the drive slide 70. At this point, the latch 87 is held in its right-hand position by the spring 88, so that it projects into the recess 106 in the drive bar 100 above the cam projection 109. Thus, as the drive bar 100 begins to move up, the cam projection 109 engages the latch 87 and pulls the bender bar 81 upwardly along with it as indicated in FIG. 14, thereby retracting the staple-forming and driving assembly 80.

As the drive slide 70 moves upwardly, the rack 74 rotates the pinion 155, which operates to pull the feed plate 150 downwardly from its neutral position. When the wire gripping assembly 160 has moved past the cam block 148, the latch 170 and the grip bar 175 are driven to the right by the spring wire 178, the toothed head 176 of the grip bar 175 engaging the wire 45 and cooperating with the bearing surface 163 securely to grip the wire therebetween, as indicated in FIG. 14. As the feed plate 150 continues moving downwardly it pulls the wire 45 along with it and feeds the leading end of the wire through a groove in the fixed cutter 192 and thence through the wire slot 214 in the wire holder 210. In this regard, it will be noted that when the staple-forming and driving assembly 80 has moved up past the wire holder 210 it permits the wire holder 210 to drop rearwardly in the sleeve 203 under the spring action of the operating arm 231 to bring the wire slot 214 into registry with the leading end of the wire 45.

The feed plate 150 continues moving downwardly until the latch 170 engages the lower cam surface 138 of the slide bar 135, for moving the latch 170 and the grip bar 175 to the left, against the urging of the spring wire 178, thereby moving the wire gripping assembly 160 to its release condition for releasing the wire 45, as indicated in FIG. 14. From this point on in the cycle no further wire will be fed from the supply roll 43.

Next, the pin 158 moves into the slot 227 of the cam 220 and rotates it, for effecting a corresponding rotation of the wire holder 210. As the wire holder 210 rotates, the portion of the wire 45 disposed therein remains stationary, sliding along the cam surfaces 216. At the same time, the cam pin 213 rides up along the cam surface 205 of the sleeve 203 for lifting the wire holder 210 axially forwardly in the sleeve 203. When the pin 158 has travelled past the cam 220, the movement of the wire holder 210 stops after a rotation of about 90°. Next, the arm 159 of the feed plate 150 engages the cutter drive slide 197 at the lower end of the recess 198 therein for moving the slide 197 downwardly. This downward movement of the drive slide 197 effects a lateral movement of the movable cutter 195 for severing the leading end of the wire 45 from the supply portion 46 thereof.

All this while the staple-forming and driving assembly 80 continues to retract until the latch 87 engages the stop surface 123 on the slide bar 120 (see FIG. 13), thereby terminating the upward movement of the bender bar 81 at the point 254 in FIG. 14. But the drive slide 70 continues moving upwardly, causing the projection 109 of the drive bar 100 to cam past the latch 87 to permit further movement of the drive bar 100. The drive slide 70 will continue moving upwardly to the top of its stroke, at which point the staple-forming and driving assembly 80 is in its fully retracted position, designated 255 in FIG. 14, and illustrated in FIG. 13. At the same time, the feed plate 150 is at the bottom of its stroke in its full feed position, designated 253 in FIG. 14 and illustrated in FIG. 10, in which the wire gripping assembly 160 is disposed in engagement with the lower stop surface 147 on the face plate 140. As the wire gripping assembly 160 moves into engagement with the stop surface 147, the lock bar 173 is driven upwardly by the stop surface 174 into its locking position in the notch in the latch 170 for locking the latch 170 and the wire gripping assembly 160 in their open or release condition (see FIG. 10).

The drive slide 70 now begins its downward movement, pushing ahead of it the staple-forming and driving assembly 80. Initially, the drive bar 100 moves downwardly until the cam projection 109 thereon engages the latch 87, whereupon further downward movement of the drive bar 100 pushes the bender bar 81 downwardly. Simultaneously, through the action of the rack and pinion mechanism, the feed plate 150 is retracted. As the feed plate 150 moves upwardly, the pin 158 moves into the slot 227 in the cam 220 for rotating same in a counterclockwise direction, thereby effecting a clockwise rotation of the wire holder 210, as indicated in FIG. 14. The severed piece of wire which is held in the wire holder 210 rotates with it to a horizontal position extending laterally across the path of the staple-forming and driving assembly 80. As the wire holder 210 rotates it drops, under the spring action of the operating arm 231 and the cam action of the cam pin 213, to a position in the path of the bender bar 81. As the bender bar side walls 83 straddle the wire holder 210, the ends of the wire segment projecting laterally beyond the wire holder 210 are picked up in the grooves of the bender bar side walls 83 and bend downwardly to form the wire segment into a generally inverted U-shaped staple, in a known manner. As the staple-forming and driving assembly 80 continues downwardly, the drive bar 100 engages the inner end of the wire holder 210 and cams it outwardly, the formed staple being carried past the wire holder 210 by the bender bar 81. At the same time, the staple support lever 90 is moved into camming engagement with the lever 67 (see FIG. 4), which pushes it forwardly to move the feet 92 between the bender bar side walls 83 to support the formed staple, this movement being controlled by the guiding movement of the cam pin 99 along the guide plate 98.

The staple-forming and driving assembly 80 continues moving downwardly in this fashion until the bender bar latch 87 engages the lower stop surface 124 of the slide bar 120 (see FIG. 12), thereby preventing further downward movement of the bender bar 81. The parts are arranged so that this occurs when the lower end of the bender bar 81 is just touching the associated workpiece to be stapled, as indicated at 257 in FIG. 14. The drive bar 100, however, continues moving downwardly, the cam projection 109 being cammed past the latch 87 to accommodate this movement. The lower end of the drive member 105 engages the bight of the formed staple and pushes it downwardly from the bender bar 81, driving it through the associated workpiece and against the associated clincher 41 for completing the stapling operation in a known manner, as indicated at 258 in FIG. 14. As the drive member 105 performs its staple-driving function, it cams the support lever 90 rearwardly out of the way, against the resilient urging of the lever 67, finally arriving at the position illustrated in FIG. 12.

All the while that the staple-forming and driving assembly 80 is moving downwardly, the feed plate 150 is being retracted. When the wire gripping assembly 160 moves upwardly past the lower cam surface 138 of the slide bar 135, the latch 170 is no longer held in its open condition by the slide bar 135, but it nevertheless remains in its open or release condition, being locked in that condition by the lock bar 173. Thus, as the wire gripping assembly 160 continues to retract, it simply slides upwardly along the support portion 45 of the wire 45, without moving it. When the feed plate arm 159 reaches the end of the recess 198 in the cutter drive slide 197, it engages the slide 197 and pulls it upwardly for retracting the movable cutter 195 to the left. In this regard, it will be noted that the friction pad 196 bears against the cutter slide 197 to hold it against accidental movement until it is driven by the arm 159.

When the lug 77 reaches the bottom of its stroke, the wire gripping assembly 160 engages the upper stop surface 146 of the face plate 140, for driving the lock bar 173 back downwardly out of locking engagement with the latch 170, the parts then being in the position illustrated in FIG. 11, indicated at 256 in FIG. 14. The lug 77 then starts back up and travels a short distance to the original neutral position illustrated in FIGS. 2–4, whereupon the cycle of operation is completed.

While, in the foregoing operation, the bender bar 81 has been described as being pulled upwardly or pushed downwardly by the action of the cam projection 109 bearing against the latch 87, this movement could occur somewhat differently. Thus, if the initial movement of the drive bar 100 is sudden and overcomes the resistance of the spring 88, the drive bar 100 could cam past the latch 87 immediately. In this event, the drive bar 100 would move independently of the bender bar 81 until the latch 87 is engaged by one of the stop surfaces 107 or 108 on the drive bar 100, whereupon continued movement of the drive bar 100 would drive the bender bar 81 until the latch 87 contacts one of the stop surfaces 123 or 124 on the slide bar 120.

It is a significant feature of the present invention that during the entire cycle of operation of the stitching head 50, the staple-forming and driving assembly 80 and the feed plate 150 move in opposite directions, thereby effectively to separate the wire feed function from the staple-forming and driving function. Thus, the wire is fed and cut in the first portion of the cycle, while the severed wire segment is formed into a staple and driven into the associated workpiece during the second portion of the cycle. At the end of the cycle there is no wire segment in the wire holder 210, the leading end of the wire 45 being disposed in the cutter housing 190 in preparation for the next cycle. While in the disclosed embodiment the reciprocating movement of the drive slide 70 is effected through a linkage coupled to a rotating drive shaft, it will be appreciated that this motion could be effected in other ways.

Figure 15:
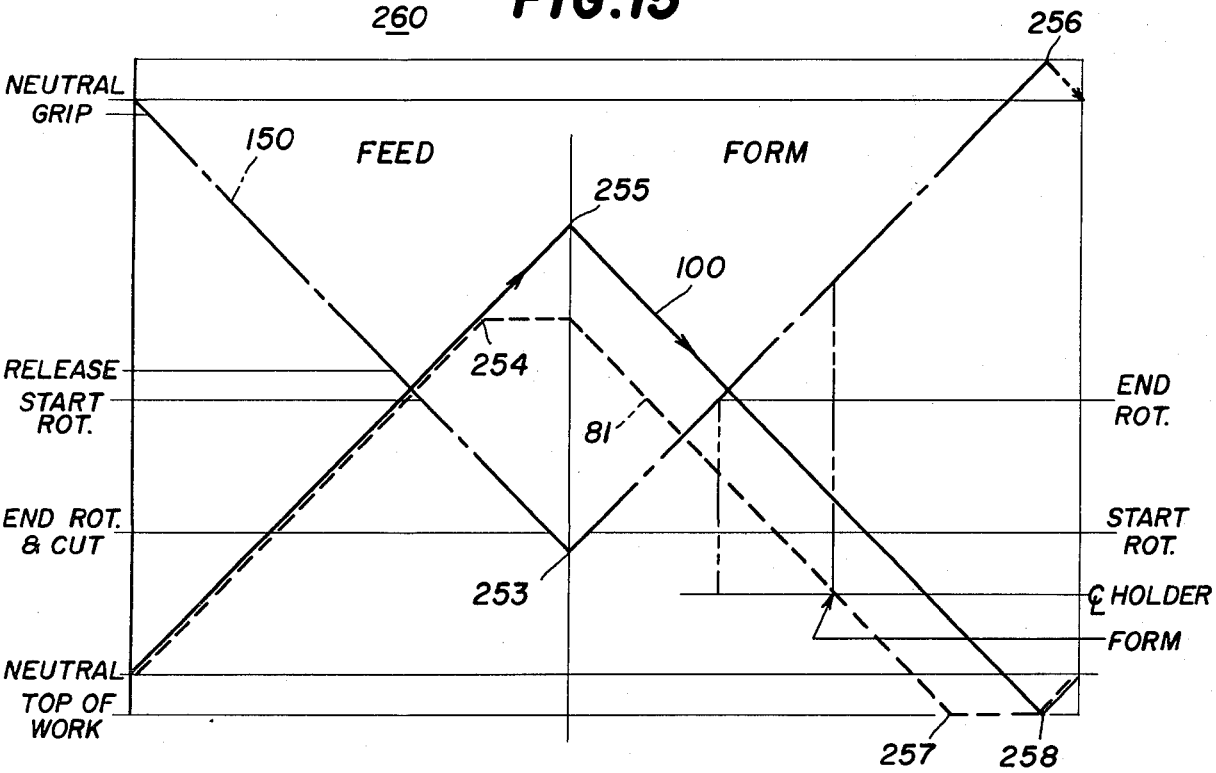
FIG. 15 is a diagram similar to FIG. 14, illustrating the movements of the parts when the mechanism is adjusted for maximum wire draw.

In FIG. 15 of the drawings there is illustrated a graphical representation of the movement of the feed plate 150, the bender bar 81 and the drive bar 100 through a complete cycle of operation of the stitching head 50, when the stitching head 50 is adjusted for maximum wire draw. It can be seen that the movement of the parts is essentially the same as for the minimum wire draw condition illustrated in FIG. 14. The principal differences are that, during the wire feed stroke the wire is released by the wire gripping assembly 160 at a lower position, and the fed wire is cut substantially simultaneously with the completion of the rotation of the wire holder 210, rather than thereafter. On the staple-forming and driving portion of the cycle, the bender bar 81 picks up the wire from the wire holder 210 for forming it subsequent to the completion of the rotation of the wire holder 210, rather than substantially simultaneously therewith. Regardless of the wire draw adjustment of the face plate 140, the drive bar 100 travels the same distance during its downward staple-forming and driving stroke, this distance being $3\frac{1}{8}$ inches in the preferred embodiment of the invention. However, it will be appreciated that by appropriate modification of the sizes and shapes of the parts, other stroke lengths could be accommodated.

From the foregoing, it can be seen that there has been provided an improved stitching head which avoids the disadvantages of prior stitching heads while affording additional stuctural and operating advantages. More specifically, there has been provided a wire stitching head which effectively separates the wire feed function from the staple-forming and driving function by moving the feed plate and the staple-forming and driving assembly in opposite directions. There results an arrangement wherein, at the end of each cycle, no severed wire segment is left in the wire holder of the stitching head. Although the stitching head 50 is disclosed as mounted on a particular type of stitching machine, it will be understood that the head 50 is useful with other types of stitching machines and other types of drive arrangements.

We claim:

1. In a cyclical wire stitching machine including means operative in each cycle for feeding and severing a length of staple wire from a continuous supply thereof, forming the severed staple wire into a staple and driving the staple through an associated workpiece and against a clincher, the improvement comprising: drive means controllable for establishing an operation cycle which begins and ends at a rest position, a wire holder, feed means coupled to said drive means and responsive thereto during a first portion of said cycle for feeding a predetermined length of wire to said wire holder and severing the predetermined length of wire from the associated supply, and staple-forming and driving means coupled to said drive means and responsive thereto during a second portion of the cycle for forming into a staple the severed length of wire fed during the first portion of the same cycle and driving the staple into the associated workpiece, whereby at the rest position of the cycle there is no wire in said wire holder.

2. The wire stitching machine of claim 1, wherein said drive means include a drive member reciprocally movable between two limit positions.

3. The wire stitching machine of claim 2, wherein said drive member is disposed intermediate said limit positions when said drive means is disposed in its rest position.

4. The wire stitching machine of claim 3, wherein said rest position is closely adjacent to one of said limit positions.

5. The wire stitching machine of claim 1, wherein said drive means includes a reciprocating drive member which moves in opposite directions respectively during said first and second portions of said cycle.

6. In a cyclical wire stitching machine including means operative in each cycle for feeding and severing a length of staple wire from a continuous supply thereof, forming the severed staple wire into a staple and driving the staple through an associated workpiece and against a clincher, the improvement comprising: drive means, feed means coupled to said drive means and responsive thereto for reciprocating movement to feed a predetermined length of wire to a stapling region, cutting means for severing the predetermined length of wire from the associated supply, and staple-forming and driving means coupled to said drive means and responsive thereto for reciprocating movement opposite to the reciprocating movement of said feed means to form into a staple the severed length of wire and drive the staple into the associated workpiece.

7. The wire stitching machine of claim 6, wherein said feed means and said staple-forming and driving means move simultaneously.

8. The wire stitching machine of claim 7, wherein said feed means is coupled to said staple-forming and driving means.

9. The wire stitching machine of claim 8, wherein said staple-forming and driving means is coupled directly to said drive means, said feed means being movable in response to movement of said staple-forming and driving means.

10. The wire stitching machine of claim 6, and further including rack and pinion means interconnecting said feed means and said staple-forming and driving means for effecting simultaneous movement thereof in opposite directions.

11. The wire stitching machine of claim 6, and further including a first rack carried by said feed means, a second rack carried by said staple-forming and driving means, and a pinion disposed between said first and second racks and in meshing engagement with each for accommodating simultaneous movement of said feed means and said staple-forming and driving means in opposite directions.

12. In a cyclical wire stitching machine including means operative in each cycle for feeding and severing a length of staple wire from a continuous supply thereof, forming the severed staple wire into a staple and driving the staple through an associated workpiece and against a clincher, the improvement comprising: a reciprocating drive member, a feed member coupled to said drive member and responsive to movement thereof for reciprocating movement opposite thereto, wire gripping means carried by said feed member and movable between a closed condition for gripping the associated wire and an open condition for releasing the associated wire, grip control means responsive to movement of said feed member for moving said wire gripping means between the opened and closed conditions thereof at predetermined points along the feed member travel path to effect feeding of a predetermined length of wire to a stapling region, cutting means for severing the predetermined length of wire from the associated supply, and staple-forming and driving means coupled to said drive member for reciprocating movement therewith to form into a staple the severed length of wire and to drive the staple into the associated workpiece.

13. The wire stitching machine of claim 12, wherein said grip control means includes fixed cam means and a cam follower coupled to said wire gripping means and disposed for camming engagement with said cam means for effecting movement of said wire gripping means.

14. The wire stitching machine of claim 13, wherein said fixed cam means includes first and second cam surfaces respectively disposed adjacent to the opposite ends of said feed member travel path.

15. The wire stitching machine of claim 12, and further including lock means movable between a locking position preventing movement of said grip control means and a releasing position accommodating movement of said grip control means between its open and closed conditions, said lock means being movable to its locking position in response to movement of said feed member to one end of its travel path for locking said grip control means in its open condition, said lock means being movable to its releasing position in response to movement of said feed member to the other end of its travel path for releasing said grip control means.

16. In a cyclical wire stitching machine including means operative in each cycle for feeding and severing a length of staple wire from a continuous supply thereof, forming the severed staple wire into a staple and driving the staple through an associated workpiece and against a clincher, the improvement comprising: first and second spaced-apart parallel rack members, drive means coupled to said first rack member for effecting reciprocating movement thereof, pinion means interconnecting said first and second rack members for effecting a reciprocating movement of said second rack member opposite to and in response to that of said first rack member, wire gripping means carried by said second rack member and movable between a closed condition for gripping the associated wire and an open condition for releasing the associated wire, grip control means responsive to movement of said second rack member for moving said wire gripping means between the open and closed conditions thereof at predetermined points along the travel path of said second rack member to effect feeding of a predetermined length of wire to a stapling region, and staple-forming and driving means coupled to said first rack member for reciprocating movement therewith to form into a staple the severed length of wire and to drive the staple into the associated workpiece.

17. The wire stitching machine of claim 16, and further including lock means movable between a locking position preventing movement of said grip control means and a releasing position accommodating movement of said grip control means between its open and closed conditions, said lock means being movable to its locking position in response to movement of said feed member to one end of its travel path for locking said grip control means in its open condition, said lock means being movable to its releasing position in response to movement of said feed member to the other end of its travel path for releasing said grip control means.

18. In a cyclical wire stitching machine including means operative in each cycle for feeding and severing a length of staple wire from a continuous supply thereof, forming the severed staple wire into a staple and driving the staple through an associated workpiece and against a clincher, the improvement comprising: drive means, a wire holder movable between a wire feeding condition and a staple forming condition, feed means coupled to said drive means and responsive thereto for reciprocating movement to feed a predetermined length of wire to said wire holder in the wire feeding position thereof, cutting means for severing the predetermined length of wire from the associated supply, control means responsive to movement of said feed means for effecting movement of said wire holder between the wire feeding and staple forming conditions thereof, and staple-forming and driving means coupled to said drive means and responsive thereto for reciprocating movement opposite to the reciprocating movement of said feed means to form into a staple the severed length of wire and drive the staple into the associated workpiece.

19. The wire stitching machine of claim 18, wherein said control means includes a control member carried by said feed means and movable therewith.

20. The wire stitching machine of claim 18, wherein said wire holder is rotatably movable about a predetermined axis in response to movement of said feed means, said control means including cam means responsive to rotation of said wire holder for effecting an axial movement thereof.

* * * * *